US010392185B2

(12) United States Patent
Tschatschula et al.

(10) Patent No.: US 10,392,185 B2
(45) Date of Patent: Aug. 27, 2019

(54) COVER FOR STORAGE TANKS

(71) Applicant: Grice Energy LLC, Lone Tree, CO (US)

(72) Inventors: Terrance Tschatschula, Centennial, CO (US); Charles Richmond Grice, Jr., Lone Tree, CO (US)

(73) Assignee: Grice Energy, LLC, Lone Tree, CO (US)

( * ) Notice: Subject to any disclaimer, the term of this patent is extended or adjusted under 35 U.S.C. 154(b) by 0 days.

(21) Appl. No.: 15/648,255

(22) Filed: Jul. 12, 2017

(65) Prior Publication Data

US 2018/0016094 A1 Jan. 18, 2018

Related U.S. Application Data

(60) Provisional application No. 62/361,230, filed on Jul. 12, 2016, provisional application No. 62/508,621, filed on May 19, 2017.

(51) Int. Cl.
*B65D 88/42* (2006.01)
*B65D 88/34* (2006.01)
(Continued)

(52) U.S. Cl.
CPC ..... *B65D 88/34* (2013.01); *B65B 7/28* (2013.01); *B65D 55/16* (2013.01); *B65D 88/02* (2013.01); *B65D 88/42* (2013.01); *B65D 88/54* (2013.01)

(58) Field of Classification Search
CPC ..... B65D 88/34; B65D 88/42; B65D 88/40; B65D 88/36; B65D 88/38; B65D 88/44;
(Continued)

(56) References Cited

U.S. PATENT DOCUMENTS 1,945,531 A * 2/1934 Kramer ..... B65D 88/34 182/1
3,049,261 A * 8/1962 Wade ..... B65D 88/34 220/216

(Continued)

FOREIGN PATENT DOCUMENTS

DE EP 0562298 A1 * 9/1993 ..... F17B 1/08

OTHER PUBLICATIONS

EP_562298_translation.pdf.*

*Primary Examiner* — Allan D Stevens
(74) *Attorney, Agent, or Firm* — Sheridan Ross P.C.

(57) ABSTRACT

A system for providing a flexible cover in a storage tank is provided that reduces the amount of vapors released from a hydrocarbon liquid and other liquids and reduces the amount of product (liquid) lost to the atmosphere. The flexible cover is, in some embodiments, comprised of one or more membranes joined together along their respect perimeter edges. The membranes are made from a material or materials that allow the cover to roll up, or otherwise reduce the cross sectional diameter or area of the cover, to allow the membrane to pass through a port in a storage tank. Once inside the storage tank, the cover may return to its normal and/or predetermined dimensions to cover the upper surface of the hydrocarbon or other liquid, which reduces the release of vapors from the hydrocarbon liquid and other liquids.

18 Claims, 4 Drawing Sheets

(51) Int. Cl.

| | |
|---|---|
| ***B65D 88/02*** | (2006.01) |
| ***B65D 55/16*** | (2006.01) |
| ***B65D 88/54*** | (2006.01) |
| ***B65B 7/28*** | (2006.01) |

(58) Field of Classification Search
CPC ..... B65D 88/46; B65D 88/48; B65D 88/50; B65D 81/245; B65D 90/28; B65D 90/42
USPC ..... 220/216–227
See application file for complete search history.

(56) References Cited

U.S. PATENT DOCUMENTS

| | | | | |
|---|---|---|---|---|
| 5,068,929 | A * | 12/1991 | Weiner | E04H 4/10 160/368.1 |
| 7,707,662 | B2 * | 5/2010 | Pesta | E04H 4/10 4/498 |
| 7,712,160 | B2 * | 5/2010 | Pesta | E04H 4/10 4/498 |
| 8,061,552 | B2 | 11/2011 | Hiner | |
| 2013/0120155 | A1 * | 5/2013 | Hagg | G01F 23/00 340/870.01 |
| 2014/0263345 | A1 * | 9/2014 | Morgan | B65D 88/34 220/495.01 |

* cited by examiner

COVER FOR STORAGE TANKS

CROSS-REFERENCE TO RELATED APPLICATIONS

This application claims priority under 35 U.S.C. § 119(e) to U.S. Provisional Patent Application Ser. No. 62/361,230 filed Jul. 12, 2016 and U.S. Provisional Patent Application Ser. No. 62/508,621 filed May 19, 2017, which are incorporated herein in their entireties by reference.

FIELD OF THE INVENTION

This invention generally relates to storage tanks, and more particularly to a cover for a hydrocarbon or any liquid that is kept in storage and stock tanks, to reduce the flashing of hydrocarbons or other liquid from the liquid phase into the vapor phase. This invention also relates to a cover for liquids kept in storage to reduce evaporation and emissions caused by that evaporation.

BACKGROUND OF THE INVENTION

There are hundreds of thousands of various storage tanks in the United States that are used to contain liquids. Storage tanks may be used to store, for example, water, waste, and consumer products such as milk. Storage tanks may also be placed in several locations such as on a vehicle or above or below the ground surface. In the oil and gas industry, storage tanks are used to store hydrocarbons at various locations, including oil refineries and smaller, remote tank batteries at oil production sites. Storage tanks for upstream oil and gas production are typically kept at or near atmospheric pressure for safety reasons and to allow the hydrocarbon liquid to be loaded into trucks for transportation to markets.

One issue with these storage tanks is the natural production of vapors. Light hydrocarbons in the crude oil or condensate—including methane and other volatile organic compounds, natural gas liquids, hazardous air pollutants, and some inert gases—vaporize or "flash" and collect in the space between the surface of the crude oil and the roof of the storage tank. This flashing of hydrocarbons reduces the volume of the crude oil stored in the tank. These vapors are often ultimately released to the atmosphere through a pressure safety valve or other vent mechanism resulting in increased air pollution and sometimes putting those facilities in violation of local, state, and federal air pollution regulations. There are several approaches to handle and control these vapors. One approach is to vent the vapors from the storage tanks and into the atmosphere. This releases pollutants into the atmosphere. When relevant governmental regulations are imposed, another approach is to ignite and flare the vapors so that the vapors are combusted. Thus, in the case of increasing governmental regulations, an operator may have to install substantial control devices to mitigate the vapor emissions. In either approach, the venting or burning of vapors represents wasted resources, atmospheric pollution, and reduced oil production.

One way to mitigate the accumulation of vapors inside of a storage tank is to incorporate a movable or floating roof into the design of the storage tank. Some prior art storage tanks in refineries have a cylindrical outer wall with a circular roof that rises and falls within the cylindrical outer wall to match the liquid level in the storage tank. This reduces the loss of vapors from the crude oil and petroleum products. However, these designs are economical only for large storage tanks. U.S. Pat. No. 8,061,552, which is incorporated herein in its entirety by reference, notes that floating-roof storage tanks are commonly between 15 and 400 feet in diameter and hold up to 1.5 million barrels of liquid or more. As such, the floating roofs are incorporated into the design of the storage tank and must be installed when the storage tank is constructed.

In contrast, floating roofs are not economical for smaller storage tanks, particularly for smaller storage tanks that have already been built and would require retrofitting. Normally, these storage tanks hold considerably less than 50,000 barrels of liquid and more frequently less than 5,000 barrels. One example of these smaller storage tanks is a tank that stores oil from stripper wells. These smaller storage tanks have fixed roofs and typically have a small access port to allow inspection and measuring. These smaller tanks handle vapor formation using the atmospheric vent approach, and it is uneconomical to retrofit the roof of these smaller storage tanks with a floating roof. In addition, environmental regulations that require burner units or other control devices to be installed may also render the producing oil well uneconomical.

Therefore, there is a need for a device, a system, and/or a method for controlling the vapor flash of hydrocarbon liquids in smaller storage tanks to prevent the loss of crude oil and petroleum products by flashing, and to prevent polluting gases from being released into the atmosphere.

SUMMARY OF THE INVENTION

It is thus an aspect of embodiments of the present invention to provide a flexible cover that covers a hydrocarbon liquid and reduces the release of vapor from the hydrocarbon liquid. In some embodiments, the flexible cover comprises materials and features that allow the flexible cover to fit through small ports or apertures and into an enclosed volume within a storage tank. Therefore, smaller storage tanks or tanks without floating roofs can utilize various embodiments of the present invention.

It is another aspect of some embodiments of the present invention to provide a flexible cover that can be rolled up, or otherwise change shape, to a smaller diameter or area such that the flexible cover may pass through an access port, thief hatch, inspection port, etc. and into the storage tank. Then, the flexible cover changes shape in a second instance to cover an upper surface of a liquid in the storage tank. In some embodiments, springs or the material characteristics of the flexible cover cause the flexible cover to change shape once inside the storage tank. In various embodiments, the flexible cover may comprise a cavity, an inflatable tube in the cavity, a membrane with an inflatable tube attached at the circumference or some combination of thereof such that inflation of the flexible cover or inflatable tube causes the flexible cover to expand and cover an upper surface of the liquid in the storage tank. The inflatable tube can be made of, for example, Nitrile, PVC, or any other material that is chemically inert to the stored liquid.

It is another aspect of embodiments of the present invention to provide a flexible cover that has a diameter smaller than the interior of the storage tank, and the flexible cover comprises a flexible flap around a perimeter of the flexible cover such that a seal is formed and maintained between the flexible cover and the interior of the storage tank.

It is an aspect of embodiments of the present invention to provide features that add further functionality to the flexible cover. For instance, the flexible cover may have an inset or opening that is aligned below a storage tank opening and allows a physical/visual inspection by any means but typically using the insertion of a sampling device of some sort to the bottom of the storage tank. Further, the flexible cover may comprise an optional flap that covers the inset or opening when inspection of the storage tank bottom is unnecessary. The flexible cover may include a grommet or other means of attachment that enables retrieval of the flexible cover.

It is another aspect of embodiments of the present invention to provide a flexible cover comprising one or more membranes made from materials that are inert to chemical attack by the stored liquid. The membranes or other portions of the flexible cover may be made from a chemically compatible polymer inert to chemical attack by a stored hydrocarbon liquid. Examples of material can include, but are not necessarily limited to, Nitrile, Nylon, Polypropylene, RYTON® (polyphenylene sulfide), PVC, VITON® (synthetic rubber and fluoropolymer elastomer), TYGON® (flexible polymer), Nitrile Butadiene, Nitrile Butadiene with a copolymer of acrylonitrile, or any other material, or combination of materials, that is chemically inert with respect to the stored liquid. The cover is fabricated in such a way that the cover or any of its components may be inflated with air or other gases and causes the device to float on the surface of the liquid after it is inserted into the interior of the storage tank. The fabrication may include hermetically sealed interconnections between membranes to form an inflatable cavity or house an inflatable tube.

It is a further aspect of embodiments of the present invention to provide a flexible cover that has one or more membranes constructed from a material that has a bulk density that is less than the density of a stored liquid such that the flexible cover floats on the stored liquid. While in some embodiments, the material, or materials, of the flexible cover may be denser than the stored liquid, the material can include a plurality of enclosed air capsules. As a result, the overall bulk density of the flexible cover is less than the density of the stored liquid. A user can roll or compress the flexible cover to pass the cover through an access port of the storage container, and then the flexible cover has sufficient shape memory to unfurl and return to an original shape and float on the surface of the stored liquid.

It is another aspect of embodiments of the present invention to provide a storage tank with a conduit that channels liquid along a path into the liquid stored in the tank. In some prior art embodiments, the storage tank inlet for the incoming oil is typically an access port on the top (roof) of the tank. The pipe from the well or the separator transports the oil to the tank and this pipe is attached to the access port on the top of the tank. The oil enters the inside of the tank through this access port and the oil splashes or otherwise falls into the tank. This can pose a problem if a flexible cover is already deployed in the storage tank. The splashing of the liquid on top of the flexible cover will generate vapors. A solution for this is to introduce the liquid below the stored liquid surface. In some embodiments of the present invention, a pipe, hose, or conduit is installed in the interior of the tank. This conduit can attach to an inlet fitting on the top of the tank and transport and channel the oil to the bottom of the tank, or at least below a liquid level and below the flexible cover in the storage tank so that oil or any other liquid does not splash on top of the membrane.

It is yet a further aspect of embodiments of the present invention to maintain the alignment or orientation of the flexible cover relative to the storage tank. Specifically, an inset or a gauging hole of the flexible cover can be aligned with an access port in the storage tank so that a user can readily access and observe the liquid level in the storage tank as well as readily take a sample of liquid out of the tank. In order to maintain the alignment of the access port and the gauging hole in the membrane of the cover, the membrane can be secured using a rope, cord, or other mechanism. This rope, cord or other mechanism can be attached to the membrane and extends vertically up to the bottom side of the tank roof. On the bottom side of the tank roof, a pulley is installed. The rope, cord or other mechanism passes through the pulley and then extends vertically downward and is attached to a weight. This weight is of sufficient weight to keep the membrane floating on top of the liquid and to keep the rope or cord taut and the access port and the gauging hole aligned. Springs, fixed pipes, rods, or other devices may be employed to maintain the gauging hole and the access port alignment.

A particular embodiment of the present invention is a flexible, substantially impermeable cover for covering a liquid in a storage tank operated to reduce the flashing of vapors, comprising a first membrane having a perimeter edge configured to contact an inner surface of a storage tank, the first membrane having a bulk density less than a liquid in the storage tank such that the first membrane is configured to float on an upper surface of the liquid, and the first membrane is comprised of at least one material that is substantially impermeable to the liquid; wherein in a first state, the first membrane is configured to fold to a reduced cross sectional area that is smaller than a cross sectional area of an access port of the storage tank; and wherein in a second state, the first membrane is configured to unfurl to an expanded cross sectional area that is larger than the reduced cross sectional area such that the perimeter edge is configured to contact the inner surface of the storage tank.

In some embodiments, the cover further comprises a second membrane having a perimeter edge, wherein the first and second membranes are interconnected at the respective perimeter edges; and a cavity formed between the first and second membranes, wherein a valve on one of the first membrane and the second membrane is configured to allow the introduction of a gas or liquid into the cavity to inflate the cover. In various embodiments, the cover further comprises an inflatable tube positioned in the cavity between the first and second membranes, wherein the valve is operatively interconnected to the inflatable tube such that the valve allows the introduction of the gas or liquid into the inflatable tube to inflate the cover. In some embodiments, the cover further comprises a flexible flap positioned around the perimeter edges of the first and second membranes, the flexible flap configured to form a seal with the inner surface of the storage tank.

In various embodiments, the cover further comprises a first inset that forms a recess in the perimeter edges of the first and second membranes; and a second inset that forms a recess in the perimeter edges of the first and second membranes. In some embodiments, the cover further comprises a grommet positioned in at least one of the first membrane and the second membrane to allow attachment of a tether to allow removal of the cover from the storage tank. In various embodiments, the first membrane comprises at least one of Nitrile, Nylon, Polypropylene, RYTON® (polyphenylene sulfide), PVC, VITON® (synthetic rubber and fluoropolymer elastomer), TYGON® (flexible polymer), Nitrile Butadiene, Nitrile Butadiene with a copolymer of acrylonitrile, and any other material that is chemically inert with respect to the liquid.

Another particular embodiment of the present invention is a system for covering a liquid in a storage tank and depositing a liquid in the storage tank, comprising a storage tank having an outer wall and a roof that form an enclosed volume, the storage tank having an access port with a cross sectional area; a liquid at least partially filling the enclosed volume of the storage tank, the liquid having an upper surface; a flexible cover having at least one membrane, the flexible cover having an uncompressed cross sectional area larger than the cross sectional area of the access port and a compressed cross sectional area smaller than the cross sectional area of the access port to allow the flexible cover to pass through the access port; an inset of the flexible cover that defines a space between the flexible cover and the storage tank; and a conduit extending through the storage tank and the space defined by the inset of the flexible cover such that an end of the conduit is positioned below the upper surface of the liquid, wherein the conduit is configured to deposit liquid from outside the storage tank to below the upper surface of the liquid.

In various embodiments, the system further comprises a tether extending from the flexible cover to an inner surface of the storage tank to maintain a relative orientation between the flexible cover and the storage tank, and a weight interconnected to an end of the tether to keep the tether taught between the flexible cover and the inner surface of the storage tank. In some embodiments, the flexible cover comprises a first membrane having a valve, the first membrane interconnected to a second membrane to define a cavity between the membranes, wherein the valve is configured to allow the introduction of a gas or liquid into the cavity to inflate the flexible cover. In various embodiments, the system further comprises an inflatable tube positioned in the cavity between the first and second membranes, wherein the valve is operatively interconnected to the inflatable tube such that the valve allows the introduction of the gas or liquid into the inflatable tube to inflate the flexible cover. In various embodiments, the system further comprises an inflatable tube positioned on the at least one membrane of the flexible cover, wherein the at least one membrane is a single membrane, and wherein a valve is operatively interconnected to the inflatable tube such that the valve allows the introduction of the gas or liquid into the inflatable tube to reduce the bulk density of the flexible cover.

In some embodiments, the flexible cover comprises a single membrane having a bulk density that is less than a bulk density of the liquid. In various embodiments, the single membrane comprises a plurality of air pockets. In some embodiments, the single membrane comprises at least one of Nitrile, Nylon, Polypropylene, RYTON® (polyphenylene sulfide), PVC, VITON® (synthetic a rubber and fluoropolymer elastomer), TYGON® (flexible polymer), Nitrile Butadiene, Nitrile Butadiene with a copolymer of acrylonitrile, and any other material that is chemically inert with respect to the liquid.

Yet another particular embodiment of the present invention is a method of placing and orienting a flexible cover over a hydrocarbon or other liquid in a storage tank, comprising (i) providing a storage tank having an outer wall and a roof that form an enclosed volume, the storage tank having an access port with a cross sectional area, the storage tank having a hydrocarbon or other liquid at least partially filling the enclosed volume, the hydrocarbon or other liquid having an upper surface; (ii) providing a flexible cover having at least one membrane, the flexible cover having an uncompressed cross sectional area larger than the cross sectional area of the access port and a compressed cross sectional area smaller than the cross sectional area of the access port; (iii) compressing the flexible cover to the compressed cross sectional area and passing the flexible cover through the access port into the enclosed volume of the storage tank; and (iv) unfurling the flexible cover from the compressed cross sectional area to the uncompressed cross sectional area so that the flexible cover substantially covers the upper surface of the hydrocarbon or other liquid.

In some embodiments, the method further comprises (v) providing the flexible cover with a first membrane having a valve, the first membrane interconnected to a second membrane to define a cavity; and (vi) operating the valve when the flexible cover is in the enclosed volume of the storage tank to inflate the cavity with air to reduce a bulk density of the flexible cover. In various embodiments, the method further comprises (vii) providing an inflatable tube in the cavity, wherein the valve is operatively interconnected to the inflatable tube such that the valve allows air into the inflatable tube to inflate the cavity. In some embodiments, the method further comprises (viii) extending a tether from the flexible cover to an inner surface of the storage tank to maintain a relative orientation between the flexible cover and the storage tank, and (ix) providing a weight on an end of the tether to keep the tether taught between the inner surface of the storage tank and the flexible cover. In various embodiments, the method further comprises (x) extending a conduit through the storage tank into the enclosed volume, through a space defined by an inset in the flexible cover, and below the upper surface of the hydrocarbon or other liquid; and (xi) depositing a hydrocarbon or other liquid through the conduit to a location below the upper surface of the hydrocarbon or other liquid. In some embodiments, the method further comprises (xii) providing a flexible flap around a perimeter edge of the flexible cover, the flexible flap is configured to form a seal with an inner surface of the outer wall of the storage tank.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
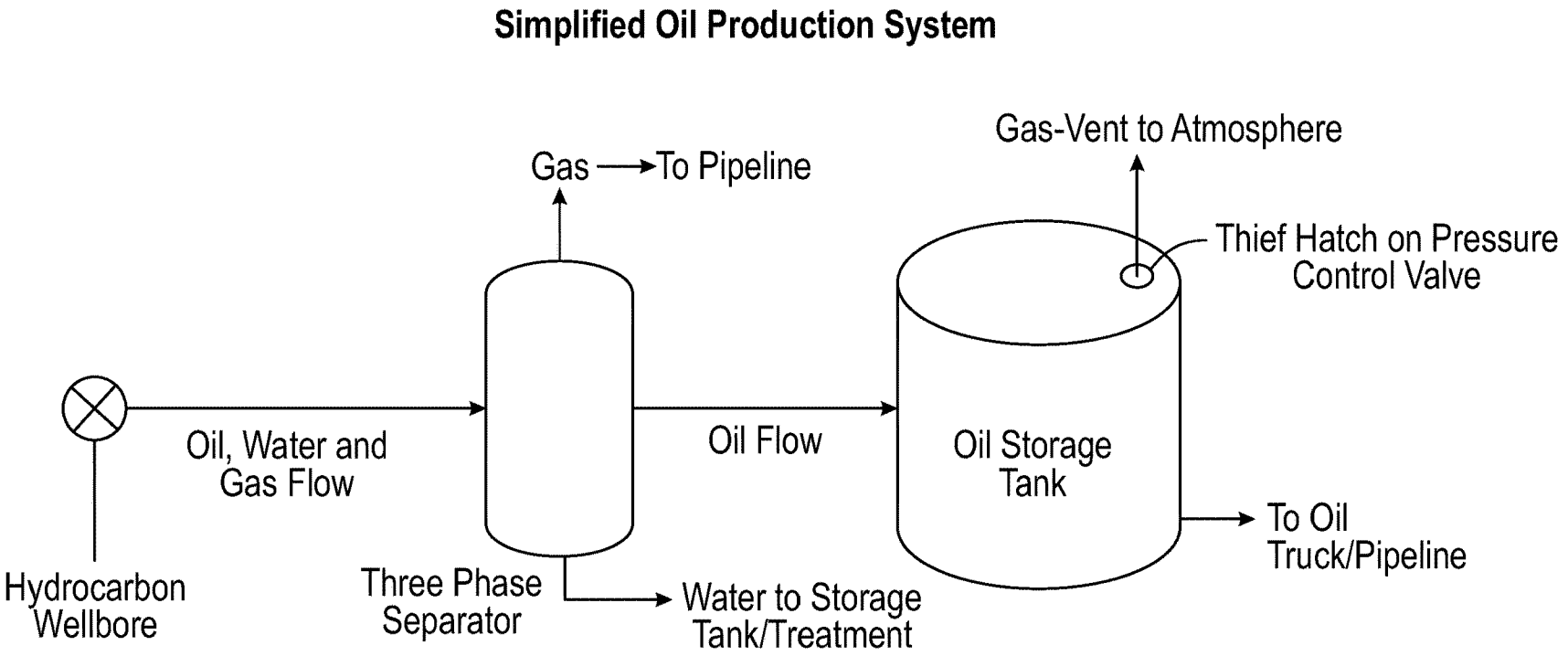
FIG. 1 is a diagram of a typical oil production tank battery in accordance with an embodiment of the present invention.

To assist in the understanding of the embodiments of the invention the following list of components and associated numbering found in the drawings is provided herein:

| Component No. | Component |
|---|---|
| 10 | Flexible Cover |
| 14 | Storage Tank |
| 16 | Access Port |
| 18 | Inlet Fitting |
| 22 | Conduit |
| 26 | First Inset |
| 30 | Grommet |
| 34 | Tether |
| 38 | Weight |
| 42a, 42b | Membranes |
| 46 | First Flap |
| 50 | Second Inset |
| 54 | First Valve |
| 58 | Inflatable Cavity |
| 62 | Inflatable Tube |
| 66 | Second Valve |
| 70 | Second Flap |
| 74 | Flap Angle |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the invention are described herein and as depicted in the drawings. It is expressly understood that although the figures illustrate covers, floating covers, flaps, etc., the invention is not limited to these embodiments.

Now referring to FIG. 1, a typical oil production tank battery is provided. Oil, gas, and water flow from the well to a separator where the oil, gas, and water are separated from each other. Then, the water flows to a water storage tank, the gas flows to a pipeline or to a flare, and the oil flows to a storage tank generally operated at an ambient pressure. In the storage tank, residual gas in the oil and oil vapors are emitted through the tank vent. The oil gathers in the storage tank until there is enough oil to fill a transport truck.

Figure 2:
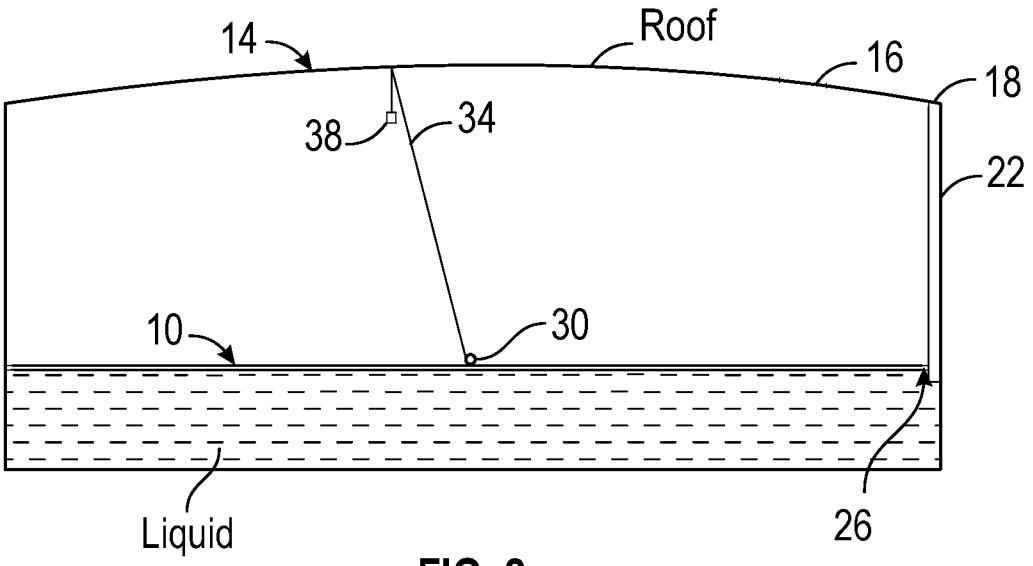
FIG. 2 is a cross sectional front elevation view of a cover in a storage tank in accordance with an embodiment of the present invention.

Now referring to FIG. 2, a system having a flexible cover 10 positioned over a hydrocarbon or other liquid in a storage tank 14 is provided. As shown, the flexible cover 10 substantially covers an upper surface of the hydrocarbon or other liquid and, in some embodiments, a perimeter edge of the flexible cover 10 contacts an inner surface of the storage tank 14 to form a seal. In this position, the flexible cover reduces the amount of vapor released by the hydrocarbon or other liquid.

It will be appreciated that in some embodiments, the flexible cover 10 has only a single layer or membrane. The single membrane can include a plurality of air pockets to reduce the bulk density of the membrane and the flexible cover 10 relative to the bulk density of the liquid in the storage tank 14. It will be further appreciated that in some embodiments, the flexible cover 10 has a bulk density that is less than the bulk density of the liquid in the storage tank 14. In some embodiments, the flexible cover 10 has a bulk density that is 80% or less than the bulk density of the liquid in the storage tank 14. In yet further embodiments, the flexible cover 10 has a bulk density that is 60% or less than the bulk density of the liquid in the storage tank 14. Further embodiments of the flexible cover 10 are depicted in FIGS. 3A-6B.

In the depicted embodiment, a conduit 22 extends from an inlet fitting 18 of the storage tank 14, through a first inset 26 of the cover 10, and into the liquid below an upper surface of the liquid. With this conduit 22 additional liquid can be added to the storage tank 14 without splashing liquid on the top of the flexible cover 10.

Also shown in FIG. 2 is a grommet 30 on the flexible cover 10 that allows an operator to retrieve the flexible cover 10 or to orient the flexible cover 10 relative to the storage tank 14 by the use of a line or tether 34 or a removable pole of any sort. The tether 34 extends from the flexible cover 10 to an inner surface of the storage tank 14. In some embodiments, the tether 34 extends through an eyelet or similar structure of the storage tank 14. This configuration allows a weight 38 to be attached to an end of the tether 34, which allows the tether 34 to remain taught. As a result, the tether 34 maintains the relative orientation of the flexible cover 10 and the storage tank 14 and so that an access port 16 can remain over a particular portion of the cover 10.

Figure 3A:
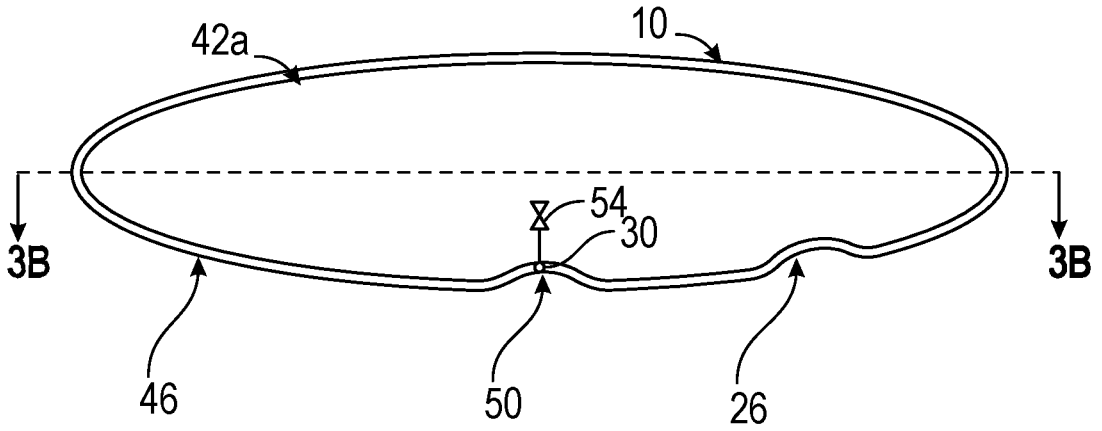
FIG. 3A is a perspective view of a cover in accordance with an embodiment of the present invention.
Figure 3B:
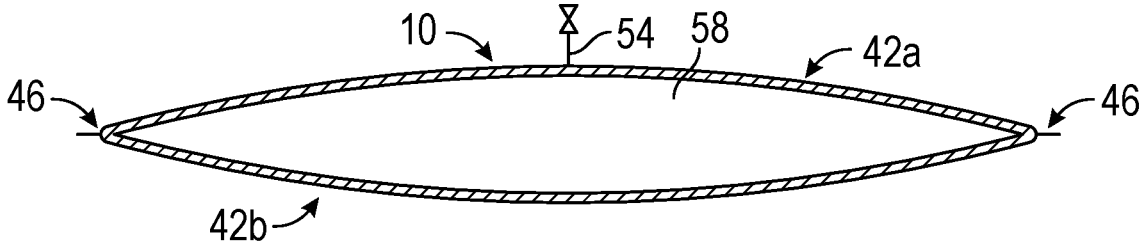
FIG. 3B is a cross sectional view of a cover taken along line 3B-3B in FIG. 3A in accordance with an embodiment of the present invention.

Now referring to FIGS. 3A and 3B, one embodiment of a flexible cover 10 is provided. FIG. 3A is a perspective view of the flexible cover 10 that shows a first, or top, membrane 42*a* that has a circular shape. The first membrane 42*a* can combine with a second membrane 42*b* to form the flexible cover 10 as shown in FIG. 3B. Once installed in the enclosed volume of a storage tank, the perimeter edge of the membranes 42*a*, 42*b* extend to the inner surface of an outer wall of the storage tank 14. In some embodiments, an optional flexible flap 46 extends from the membranes 42*a*, 42*b* to the inner surface of the outer wall of the storage tank 14, and forms a seal with the inner surface to more effectively prevent flashing of the hydrocarbon liquid or evaporation of the stored liquid.

The membranes 42*a*, 42*b* may be made from chemically inert material so as not to interact with hydrocarbons or other liquid, air, the material of the storage tank, or any other materials in the system. Examples of possible materials include polymers such as nylon and polyethylene, or other materials which are substantially impermeable to hydrocarbon vapors or gases. Such materials may be coated with other treatments to further impede the flashing of vapors and protect the material. In addition, the membranes material may be flexible to allow the cover to roll, or otherwise change shape, to a reduced cross sectional diameter or area to fit through the maximum diameter or cross sectional area of an access port or inlet fitting in the storage tank.

As shown in FIG. 3A, one or more insets 26, 50 may be positioned on the perimeter edge of the first membrane 42*a* and the cover 10. A first inset 26 provides access from the access port of the storage tank to the upper surface of the hydrocarbons or other liquid in the storage tank 14, and the first inset 26 further provides access to the bottom of the storage tank 14 through the hydrocarbons or other liquids such that any pipe or conduit that can run from the top of the storage tank 14 into the liquid. The second inset 50 can provide, for instance, access to the grommet 30 or other feature for maintaining the orientation and position of the flexible cover 10 relative to the storage tank.

FIG. 3B shows a cross sectional view of the flexible cover 10 taken along line 3B-3B of FIG. 3A. First and second membranes 42*a*, 42*b* are shown. The first and second membranes 42*a*, 42*b* may be mechanically joined together along perimeter edges of the first and second membranes 42*a*, 42*b*. It will be appreciated that the perimeter edges of the first and second membranes 42*a*, 42*b* may be joined by non-mechanical means, for example, an adhesive or sealant. Further, the flexible flap 46 may be used to join the first and second membranes 42*a*, 42*b*.

A cavity 58 is formed between the first and second membranes 42*a*, 42*b*, and an air/liquid valve 54 on one of the membranes 42*a*, 42*b* provides access to the cavity 58. Therefore, once the flexible cover 10 is placed in the enclosed volume of the storage tank, the air/liquid valve 54 may be operated to allow air or other gases or liquids into the cavity 58, which inflates the flexible cover 10 to its original shape or to a shape that covers the most surface area of a liquid in the storage tank. In some embodiments, the pressure within the cavity 58 can range between approximately 0 and 15 psig. It will be appreciated that there are many ways to inflate the cavity 58 including allowing ambient air into a cavity 58 that has open-cell foam where the cells expand from a compressed state to an uncompressed state and draw in air, a user blowing into the cavity 58, a pump, a propellant such as nitroguanidine, phase-stabilized ammonium nitrate (NH4NO3) or other nonmetallic oxidizer, and a nitrogen-rich fuel different from azide (e.g. tetrazoles, triazoles, and their salts).

Figure 4A:
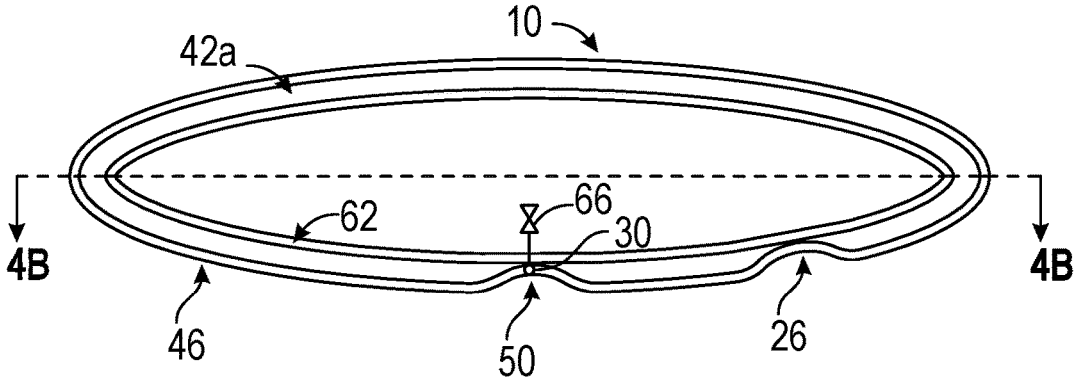
FIG. 4A is a perspective view of another cover in accordance with an embodiment of the present invention.
Figure 4B:
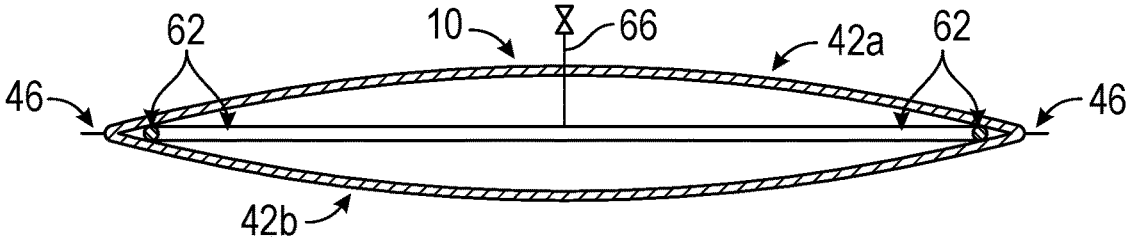
FIG. 4B is a cross sectional view of a cover taken along line 4B-4B in FIG. 4A in accordance with an embodiment of the present invention.

Now referring to FIGS. 4A and 4B, a second embodiment of the flexible cover 10 is provided. FIG. 4A is a perspective view of the flexible cover 10, and FIG. 4B is a cross sectional view of the flexible cover 10 taken along line 4B-4B in FIG. 4A. This flexible cover 10 has many features similar to those of the flexible cover 10 in FIGS. 3A and 3B. For instance, the flexible cover 10 in FIGS. 4A and 4B has membranes 42*a*, 42*b*, a flap 46, insets 26, 50, and a valve 66.

However, the valve 66 in the flexible cover 10 in FIGS. 4A and 4B is operatively interconnected to an inflatable tube 62. After the flexible cover 10 is installed in the enclosed volume of the storage tank, the valve 66 may be actuated to allow air into the inflatable tube 62, which causes the flexible cover 10 to return to its original shape, or otherwise extends the flexible cover's optional flap to cover the most surface area of a liquid in the storage tank. The inflatable tube 62 in FIGS. 4A and 4B is a ring, but it will be appreciated that the inflatable tube 62 may have a variety of shapes and configurations, including multiple interconnected chambers, electronic control systems, etc.

Figure 5:
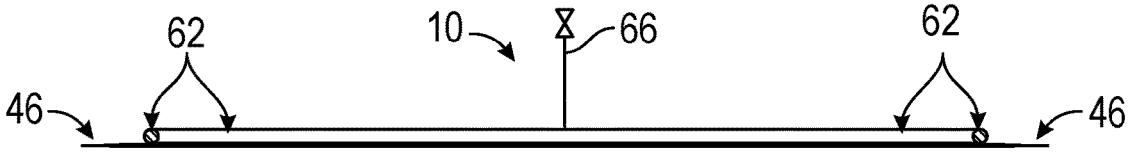
FIG. 5 is a cross sectional view of another embodiment of a cover.

It will be further appreciated that the cavity in which the inflatable tube 62 is positioned may also be inflatable or collapsed in some embodiments. In the collapsed embodiments, the cross sectional profile of the flexible cover 10 would generally be flat with the exception of the location of the inflatable tube 62. Further still, in some embodiments, a single membrane has the inflatable tube 62 embedded within the membrane, and the single membrane has a generally constant cross sectional profile with the exception of the location of the inflatable tube 62. As shown in FIG. 5, the flexible cover 10 may have a single membrane with an inflatable tube 62 positioned on the membrane. In addition, the flexible cover 10 in FIG. 5 has a valve 66 operably interconnected to the inflatable tube 62 and flaps 46 extending to an inner surface of a storage tank.

Figure 6A:
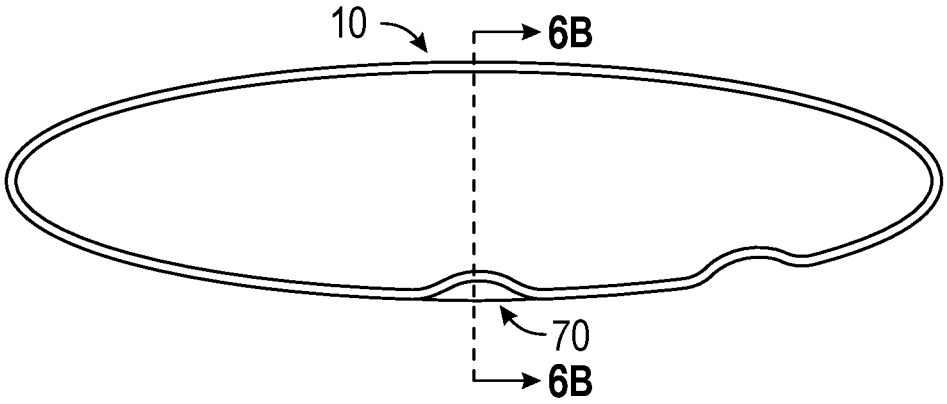
FIG. 6A is a perspective view of a cover in accordance with an embodiment of the present invention.
Figure 6B:
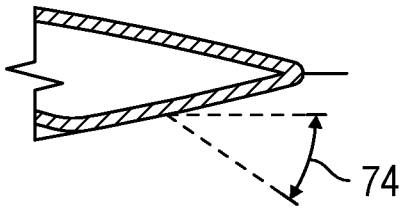
FIG. 6B is a partial cross sectional view of a cover taken along line 6B-6B in FIG. 6A in accordance with an embodiment of the present invention.

Now referring to FIGS. 6A and 6B, a perspective view of a flexible cover 10 and a cross sectional view of the flexible cover 10 taken along line 6B-6B of FIG. 6A are provided, respectively. These figures show the optional flap 70 where the flap 70 floats towards an upper surface of a liquid at a flap angle 74 during normal operation in a storage tank, which seals off the liquid from the vapor space of the storage tank. When access to the tank bottom is needed, the flap 70 can be pushed downward into the liquid.

In further embodiments, a device such as a spray gun may be used to introduce a film or layer on the upper surface of the hydrocarbons or other liquid to prevent flash of vapors. The film may be similar in consistently to paraffin wax where the spray gun can heat and deliver the wax to the upper surface of the hydrocarbons or other liquid. Then, clusters of wax may combine into a film that covers the upper surface of the hydrocarbons or other liquid.

While embodiments of the present invention are described with respect to oil storage tanks and hydrocarbon or other liquids, it will be appreciated that the present invention may be applied to a wider range of containers and contents of containers.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A system for covering a liquid in a storage tank and depositing said liquid in said storage tank, comprising:

said storage tank having a bottom, an outer wall, and a roof that form an enclosed volume, said storage tank having an access port with a cross sectional area;

said liquid at least partially filling said enclosed volume of said storage tank, said liquid having an upper surface;

a flexible cover having at least one membrane, said flexible cover having an uncompressed cross sectional area larger than said cross sectional area of said access port and a compressed cross sectional area smaller than said cross sectional area of said access port to allow said flexible cover to pass through said access port;

an inset of said flexible cover that defines a space between said flexible cover and said storage tank; and a conduit having an open upper end and an open lower end, wherein said conduit extends through said storage tank and said space defined by said inset of said flexible cover such that said lower end of said conduit is positioned below said upper surface of said liquid, wherein said lower end of said conduit is offset from said bottom of said storage tank by a predetermined distance, wherein said conduit is configured to deposit liquid from outside said storage tank to below said upper surface of said liquid.

2. The system of claim 1, further comprising a tether extending from said flexible cover to an inner surface of said storage tank to maintain a relative orientation between said flexible cover and said storage tank, and a weight interconnected to an end of said tether to keep said tether taut between said flexible cover and said inner surface of said storage tank.

3. The system of claim 1, wherein said flexible cover comprises a first membrane having a valve, said first membrane interconnected to a second membrane to define a cavity between said membranes, wherein said valve is configured to allow the introduction of a gas or liquid into said cavity to inflate said flexible cover.

4. The system of claim 1, further comprising:

an inflatable tube positioned on said at least one membrane of said flexible cover, wherein said at least one membrane is a single membrane, and wherein a valve is operatively interconnected to said inflatable tube such that said valve allows the introduction of a gas or liquid into said inflatable tube to reduce the bulk density of the flexible cover.

5. The system of claim 1, wherein said flexible cover comprises a single membrane having a bulk density that is less than a bulk density of said liquid.

6. The system of claim 5, wherein said single membrane comprises a plurality of air pockets.

7. The system of claim 5, wherein said single membrane comprises at least one of Nitrile, Nylon, Polypropylene, Ryton® (polyphenylene sulfide), PVC, Viton® (synthetic rubber and fluoropolymer elastomer), Tygon® (flexible polymer), Nitrile Butadiene, Nitrile Butadiene with a copolymer of acrylonitrile, and any other material that is chemically inert with respect to said liquid.

8. The system of claim 1, wherein the at least one membrane is a continuous first membrane and a continuous second membrane joined to each other about a perimeter edge to define a cavity.

9. The system of claim 8, wherein said cavity is inflatable from a first volume to a larger second volume.

10. The system of claim 1, wherein said access port is a thief hatch.

11. A method of placing and orienting a flexible cover over a hydrocarbon or other liquid in a storage tank, comprising:

providing said storage tank having a bottom wall, an outer wall, and a roof that form an enclosed volume, said storage tank having an access port with a cross sectional area, said storage tank having said hydrocarbon or other liquid at least partially filling said enclosed volume, said hydrocarbon or other liquid having an upper surface;

providing the flexible cover having at least one membrane, said flexible cover having an uncompressed cross sectional area larger than said cross sectional area of said access port and a compressed cross sectional area smaller than said cross sectional area of said access port;

compressing said flexible cover to said compressed cross sectional area and passing said flexible cover through said access port into said enclosed volume of said storage tank;

unfurling said flexible cover from said compressed cross sectional area to said uncompressed cross sectional area so that said flexible cover covers said upper surface of said hydrocarbon or other liquid;

extending a conduit through said storage tank into said enclosed volume, through a space defined by an inset in said flexible cover, and below said upper surface of said hydrocarbon or other liquid, wherein said conduit has an open upper end and an open lower end; and depositing a hydrocarbon or other liquid through said conduit to said open lower end at a location below said upper surface of said hydrocarbon or other liquid, wherein said open lower end of said conduit is offset from said bottom of said storage tank by a predetermined distance.

12. The method of claim 11, further comprising:

providing said flexible cover with a first membrane having a valve, said first membrane interconnected to a second membrane to define a cavity; and operating said valve when said flexible cover is in said enclosed volume of said storage tank to inflate said cavity with air to reduce a bulk density of said flexible cover.

13. The method of claim 12, further comprising providing an inflatable tube in said cavity, wherein said valve is operatively interconnected to said inflatable tube such that said valve allows air into said inflatable tube to inflate said cavity.

14. The method of claim 11, further comprising extending a tether from said flexible cover to an inner surface of said storage tank to maintain a relative orientation between said flexible cover and said storage tank, and providing a weight on an end of said tether to keep said tether taut between said inner surface of said storage tank and said flexible cover.

15. The method of claim 11, further comprising:

providing a flexible flap around a perimeter edge of said flexible cover, said flexible flap is configured to form a seal with an inner surface of said outer wall of said storage tank.

16. The method of claim 11, wherein the at least one membrane is a continuous first membrane and a continuous second membrane joined to each other about a perimeter edge to define a cavity.

17. The method of claim 16, further comprising:

inflating said cavity from a first volume to a larger second volume.

18. The method of claim 11, wherein the access port is a thief hatch.

* * * * *